US009668571B1

(12) United States Patent
Ghobadi

(10) Patent No.: US 9,668,571 B1
(45) Date of Patent: Jun. 6, 2017

(54) ADJUSTABLE-FOLDABLE DESK

(71) Applicant: Kamran Ghobadi, Irvine, CA (US)

(72) Inventor: Kamran Ghobadi, Irvine, CA (US)

( * ) Notice: Subject to any disclaimer, the term of this patent is extended or adjusted under 35 U.S.C. 154(b) by 0 days.

(21) Appl. No.: 15/249,391

(22) Filed: Aug. 27, 2016

Related U.S. Application Data

(60) Provisional application No. 62/214,889, filed on Sep. 4, 2015.

(51) Int. Cl.

| | |
|---|---|
| ***A47B 13/00*** | (2006.01) |
| ***A47B 9/16*** | (2006.01) |
| ***A47B 21/013*** | (2006.01) |
| ***A47B 13/08*** | (2006.01) |
| ***A47B 3/00*** | (2006.01) |
| ***A47B 21/02*** | (2006.01) |

(52) U.S. Cl.
CPC ..... *A47B 13/081* (2013.01); *A47B 3/002* (2013.01); *A47B 9/16* (2013.01); *A47B 21/02* (2013.01)

(58) Field of Classification Search
CPC ..... A47B 3/002; A47B 9/16; A47B 13/081; A47B 21/02; F16M 11/38; F16M 13/022
USPC ..... 108/107, 138–141, 145, 147.22
See application file for complete search history.

(56) References Cited

U.S. PATENT DOCUMENTS

| | | | | | |
|---|---|---|---|---|---|
| 2,545,515 | A * | 3/1951 | Mast | A47B 9/00 | 108/138 |
| 3,203,373 | A * | 8/1965 | King | D06F 81/04 | 108/116 |
| 4,248,161 | A * | 2/1981 | Adair | A47B 27/02 | 108/6 |
| 6,158,359 | A * | 12/2000 | Allan | A47B 21/0314 | 108/1 |
| 6,643,960 | B2 * | 11/2003 | Manfiotto | D06F 81/04 | 38/137 |
| 8,898,862 | B1 * | 12/2014 | McGrath | E05D 11/1007 | 16/326 |
| 9,049,923 | B1 * | 6/2015 | Delagey | A47B 9/18 | |
| 9,399,882 | B1 * | 7/2016 | McGrath | E05D 11/1007 | |
| 9,504,316 | B1 * | 11/2016 | Steicher | A47B 21/02 | |
| 9,554,644 | B2 * | 1/2017 | Flaherty | A47B 9/16 | |
| 2006/0185566 | A1 * | 8/2006 | Mangano | A47B 3/00 | 108/115 |
| 2015/0289641 | A1 * | 10/2015 | Ergun | A47B 9/16 | 108/42 |
| 2017/0020280 | A1 * | 1/2017 | Chuang | A47B 9/16 | |

* cited by examiner

*Primary Examiner* — Joshua Rodden
(74) *Attorney, Agent, or Firm* — Genius Patent APC; Bruce Hare

(57) ABSTRACT

An adjustable-foldable desk to be mounted on top of stationary desks, tables and counters with no attachments. Desk comprises leg(s) assemblies on left and right sides whereby connect desktop to the base of the desk. Spring-loaded buttons at upper portion of the leg(s) assemblies allow to release the engagement of the desktop in order to adjust the tilt of the desktop. Also, spring-loaded buttons at lower portions of the leg(s) assemblies allow to release the engagement of the leg with the base in order to swing the leg and substantially desktop in order to adjust the height of the desk.

3 Claims, 15 Drawing Sheets

200

ADJUSTABLE-FOLDABLE DESK

CROSS-REFERENCE TO RELATED APPLICATION

This application claims the benefit of U.S. Provisional Application No. 62/214,889, filed Sep. 4, 2015.

BACKGROUND

Long-term postures while working with computers, laptops, writing or drawing have negative impact on health of the users. In the same manner sitting long time at fixed desks can cause fatigue and joints pains. The present invention is a foldable desk which can be adjusted in different heights and angles. It enables users to change their postures relative to the invention while working with computers and laptops. This new desk is mountable on top surface of all kinds of desks, tables or counters and allows users to take healthy postures relative to it while sitting or standing. In one aspect the invention can be used for desktop monitors, keyboards and laptops. Also, users can write and draw on adjustable desk while they can adjust angle and height of the desk to their comfort.

SUMMARY

The following is intended to be summary of the invention and is not intended to limit the scope of the invention.

The invention is mounted on top surface of any kind of desk, table or counter with no attachments. Users can adjust the height of the desk relative to themselves by releasing two identical spring-loaded latches at left and right sides of the desk. Similarly angle of the desktop can be adjusted by releasing two identical spring-loaded latches at left and right sides of the desk.

Invention comprises desktop embodiment, two identical leg assemblies at left and right sides, base assembly and synchronization bar. Left and right leg assemblies are attaching base assembly to the desktop embodiment. Synchronization bar attaches the right leg assembly to the left leg embodiment, stabilizes the structure and make left leg and right leg assemblies rotate together.

DETAILED DESCRIPTION OF THE PRESENTLY PREFERRED ASSEMBLIES

Figure 1:
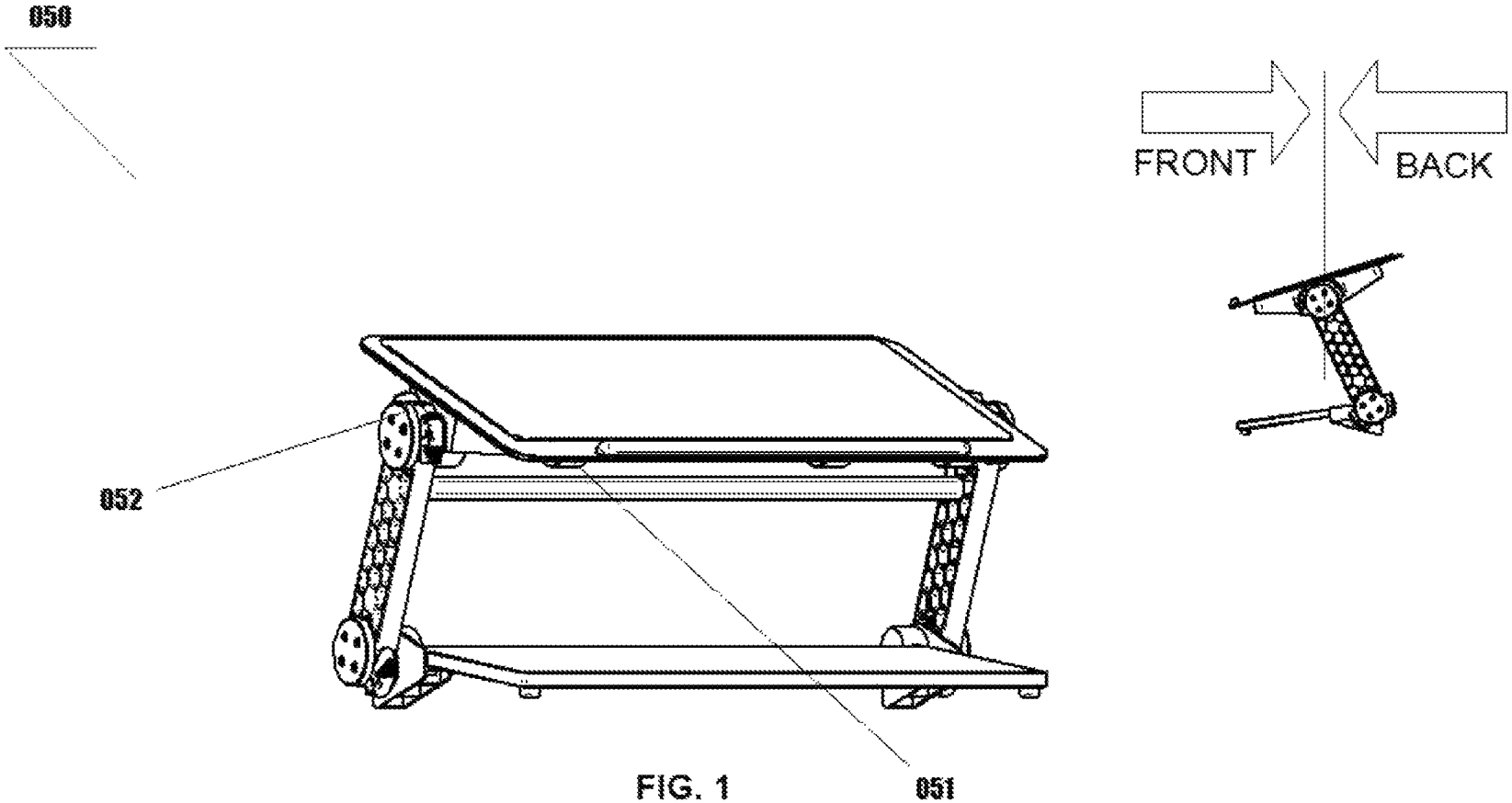
FIG. 1 shows isometric front view of the invention.

FIG. 1 depicts the front isometric view of the invention while user can interact with invention from this side. Since the desktop assembly 051 in diagram 050 can pivot on revolute-locking-joint of leg 052 from 0 to 180 degrees, users can interact with the desk from back side as well. Front and back sides of the invention are shown in diagram 050.

Figure 2:
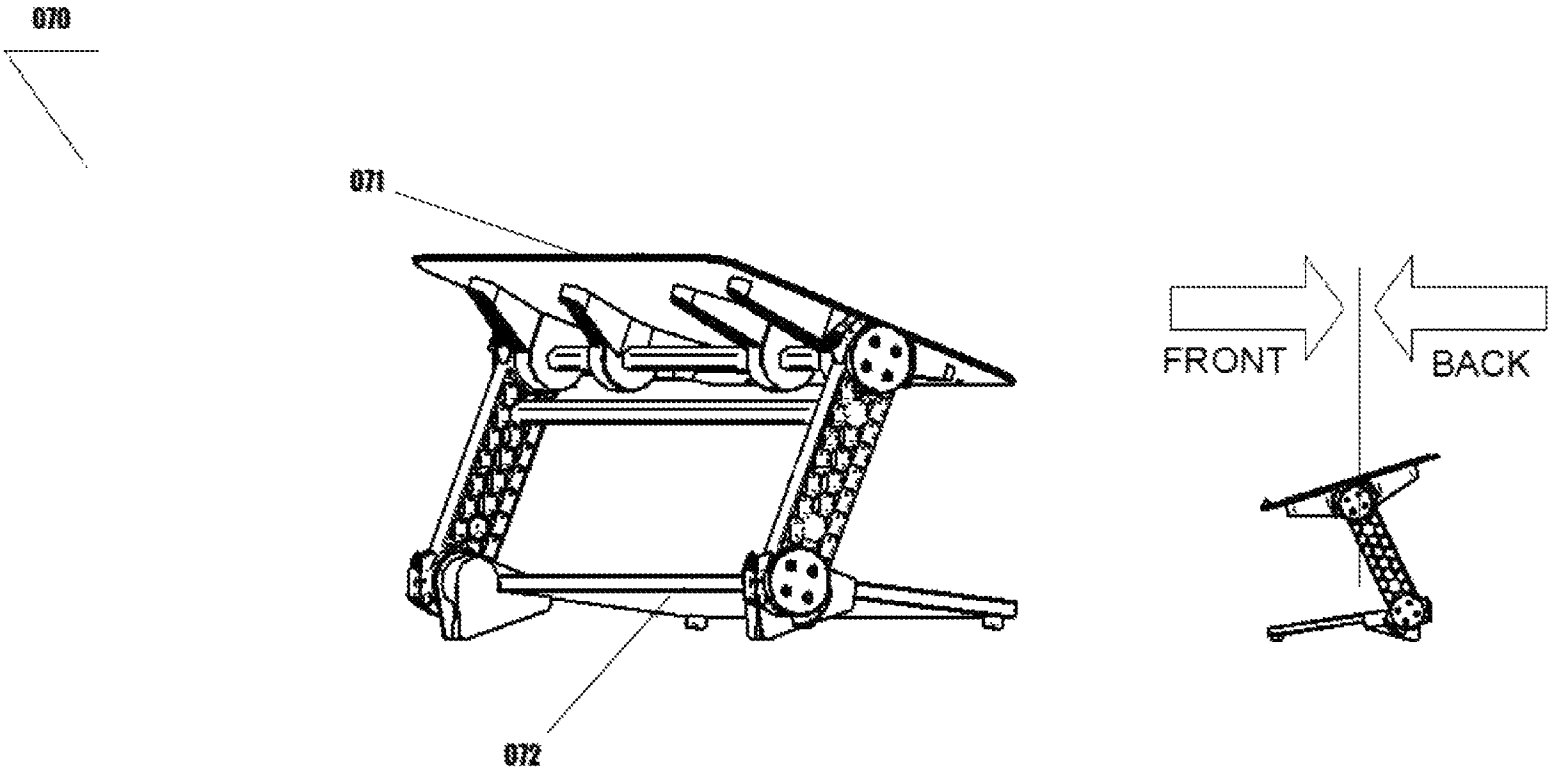
FIG. 2 shows isometric back view of the invention.

FIG. 2 depicts the back isometric view of the invention while user can interact with invention from this side. Since the desktop assembly 071 in diagram 070 can pivot on leg revolute-locking-joint 072 from 0 to 180 degrees, users can interact with the desk from front side as well. Front and back sides of the invention are shown in diagram 070.

Figure 3:
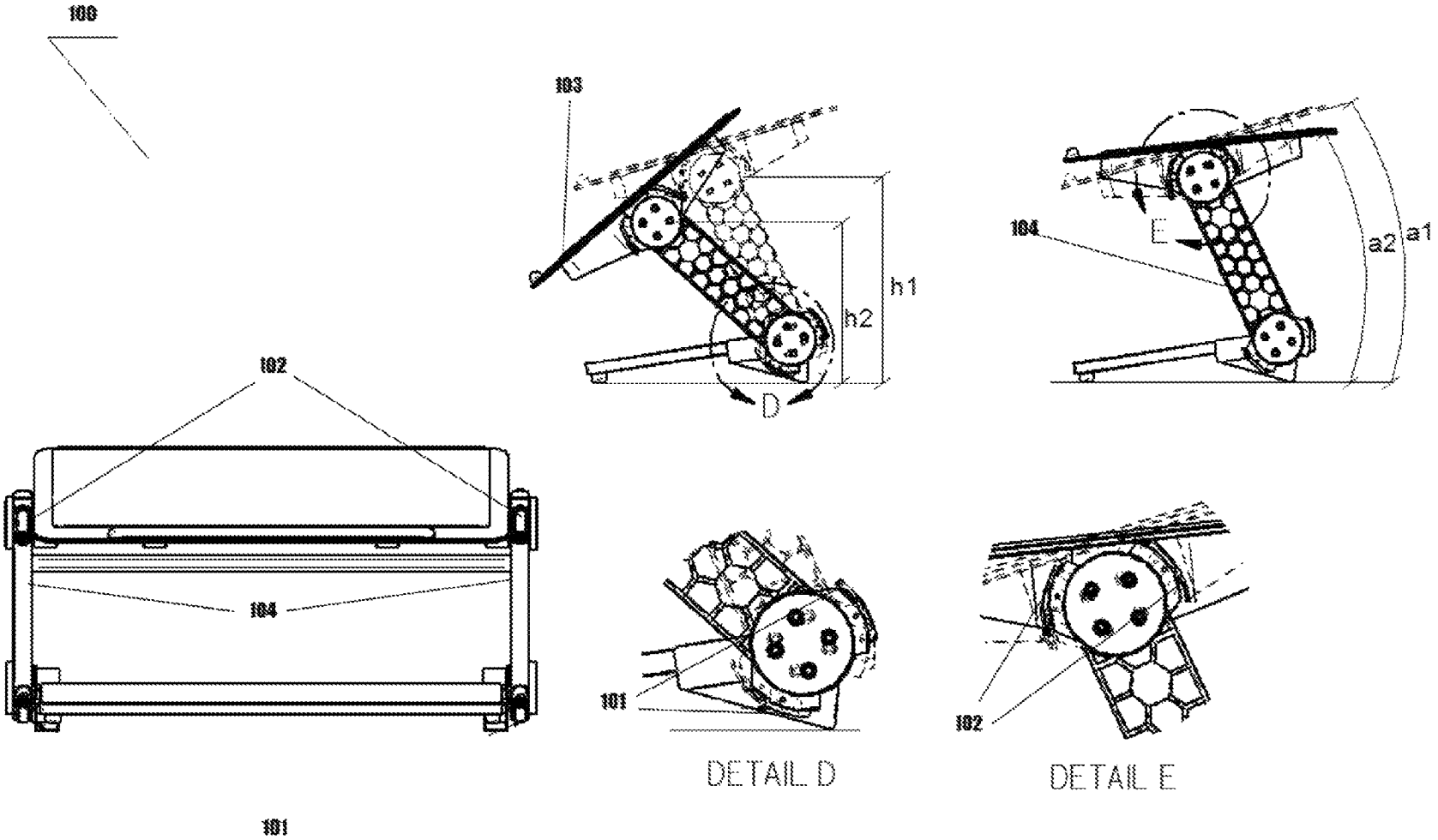
FIG. 3 shows height and angle adjustment methods of the desktop assembly 103 by pressing release buttons 101 and 102 on left and right sides of the invention.

FIG. 3 shows adjustment of the height of the desktop assembly 103 from h1 to h2 in diagram 100, user fingers press four buttons 101 on left and right sides of the desk. While four buttons 101 are pressed legs 104 are held by user's hand and moved from h1 to h2. When desktop reaches the position h2 four buttons 101 are released and legs lock in position. Detail view D in diagram 100 shows release buttons in close up view for one side of the device. Likewise, for adjustment of the angle of the desktop assembly 103 from a1 to a2 in diagram 100, user fingers press four buttons 102 on left and right sides of the desk. While four buttons 102 are pressed desktop assembly 103 is held by user's hands and moved from a1 to a2. When desktop reaches the position a2 four buttons 102 are released and desktop assembly 103 locks in position. Detail view E in diagram 100 shows release buttons in close up view for one side of the device.

Figure 4:
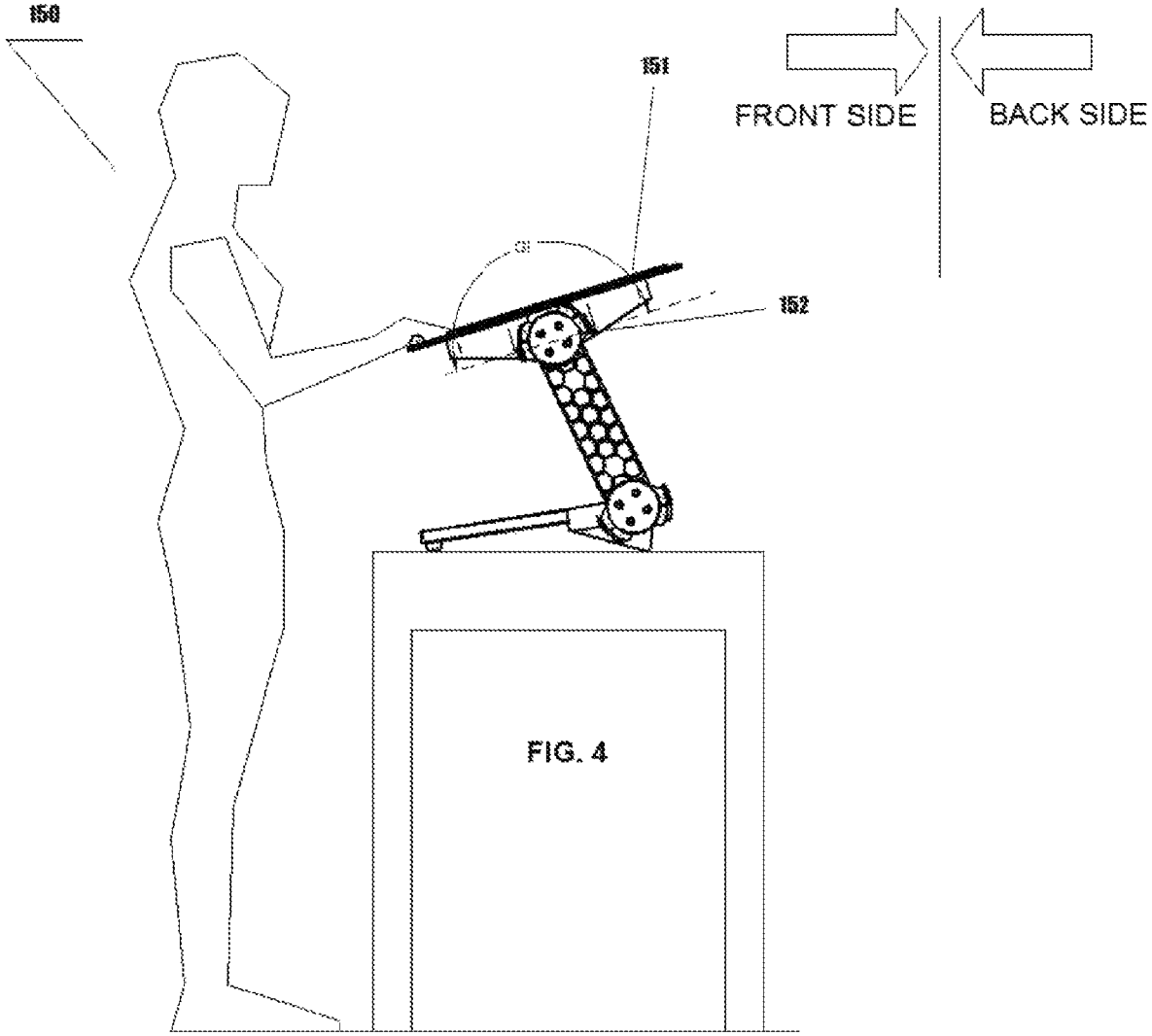
FIG. 4 shows user standing posture when interacting with the invention.

FIG. 4 depicts the user standing posture interacting with the invention from front side. Desktop assembly 151 can pivot around left and right legs 152 cylindrical faces from 0 to 180 degree so the device can be used from the back side as well. Desktop assembly angle a1 can be positioned from 0 to 180 degree depending on user's preference.

Figure 5:
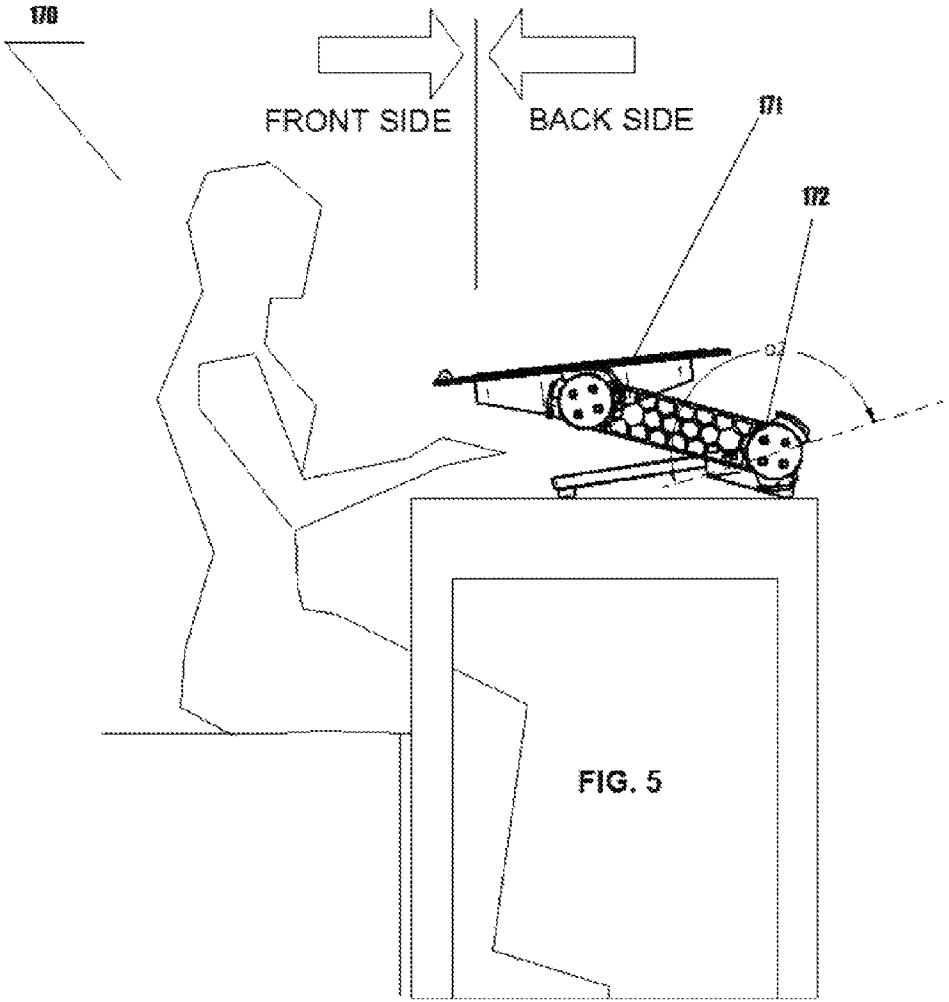
FIG. 5 shows user sitting posture when interacting with the invention.

FIG. 5 depicts the user sitting posture interacting with the invention from front side. Desktop assembly 171 can pivot around left and right leg 172 cylindrical faces from 0 to 180 degree so the device can be used from the back side as well. Legs angle a2 can be positioned from 0 to 180 degree depending on user's preference which eventually leads to adjustment height of the desktop assembly 171.

Figure 6:
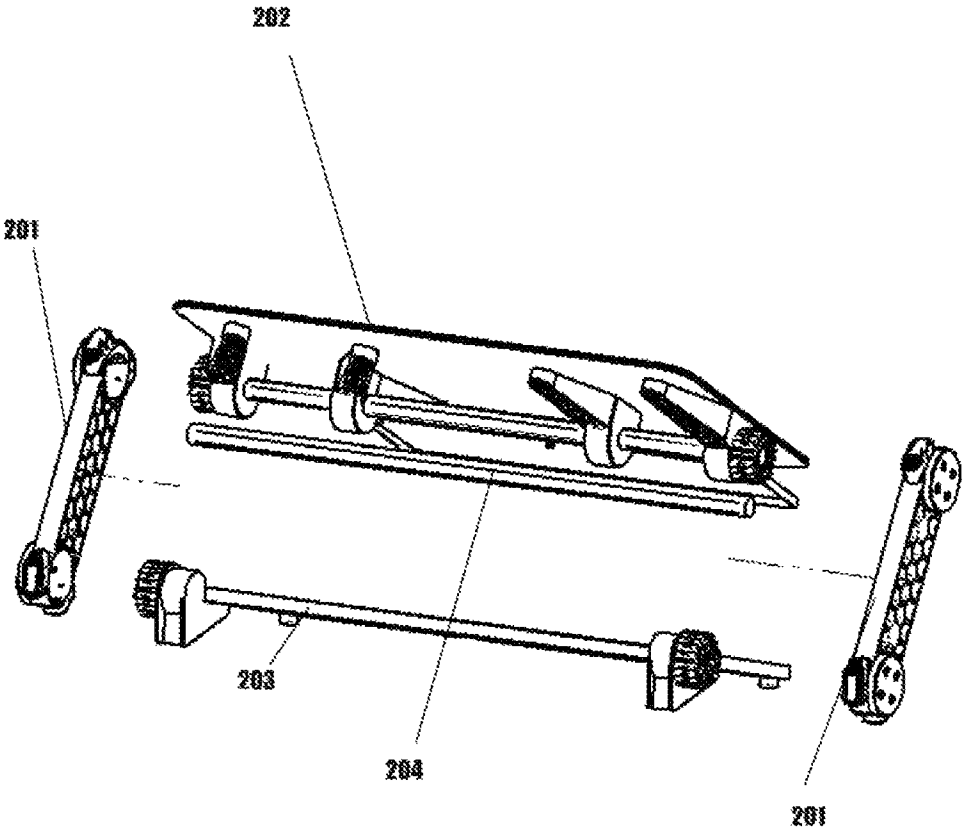
FIG. 6 shows the main assembly and engagement of sub-assemblies. Main assembly of the invention includes two leg assemblies 201, desktop assembly 202, base assembly 203 and synchronization bar 204.

FIG. 6 shows preferred embodiment of the all sub-assemblies and parts. Exploded view in diagram 200 shows identical leg assemblies 201 are connecting desktop assembly 202 to base assembly 203. In order to keep desktop assembly 202 level, synchronization bar 204 connects left and right leg assemblies 201 and ensures that both legs are moving together.

Figure 7:
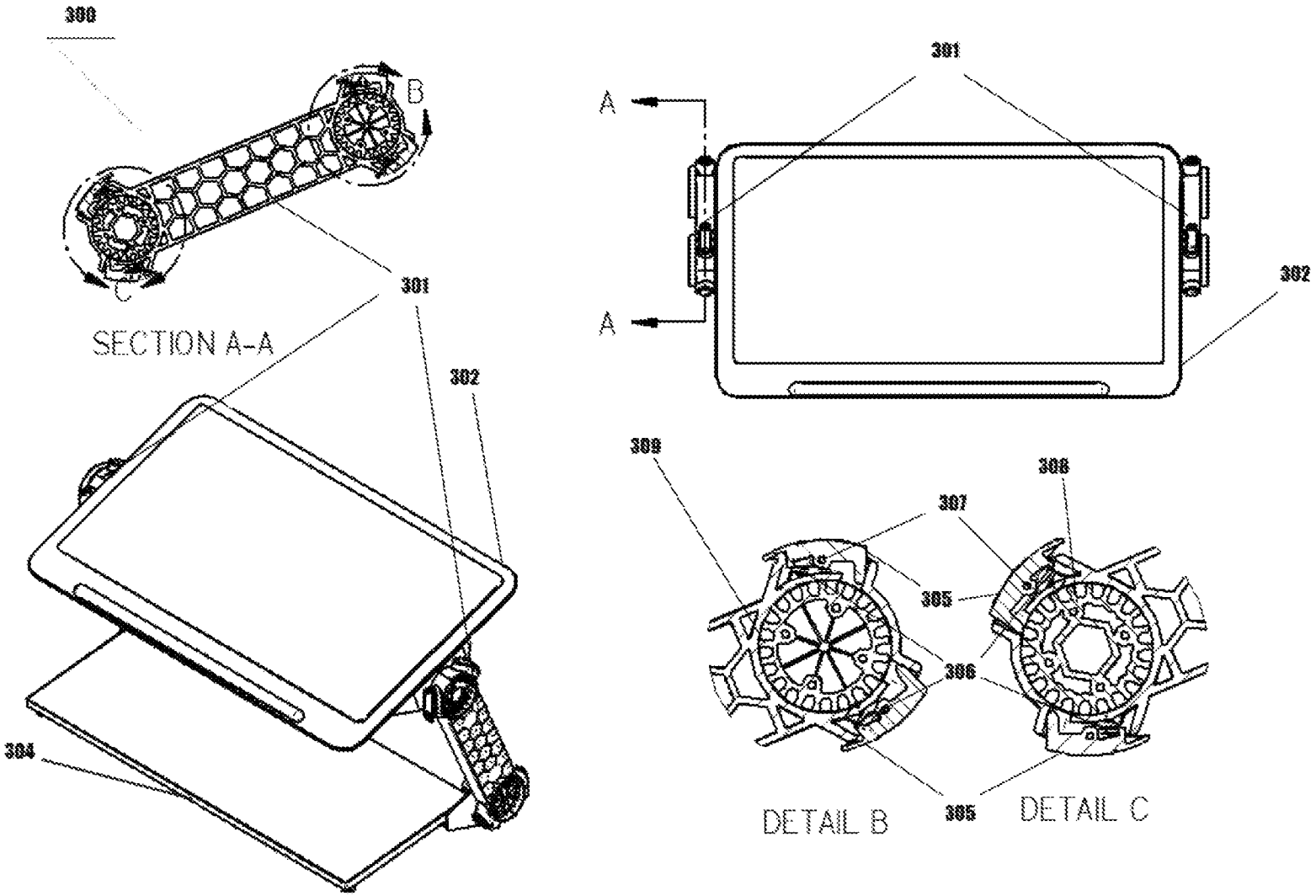
FIG. 7 shows the locking mechanism of pivoting legs 301.

FIG. 7 shows lock mechanism of two leg assemblies. Section view A-A shows left leg assembly 301 which is identical to right leg assembly 301. Detail views B and C are close up views of the lock mechanisms at junction of the leg assemblies 301 with desktop assembly 302 and base assembly 304. Buttons 305 are pivoting around pins 307 and their tongues get engaged by pushing of springs 306. So buttons 305 tongues get engaged with toothed wheels 309 where are located on both sides of the invention base assembly 304 and toothed wheels 308 where are located on both sides of the desktop assembly 302. By pressing buttons 305 on both side, buttons tongues get disengaged and toothed wheels 308 and 309 are free to rotate. Therefore desktop assembly 304 can tilt from 0 to 180 degree. Also leg assemblies 301 can pivot around toothed wheels 309 on both sides of the device.

Figure 8:
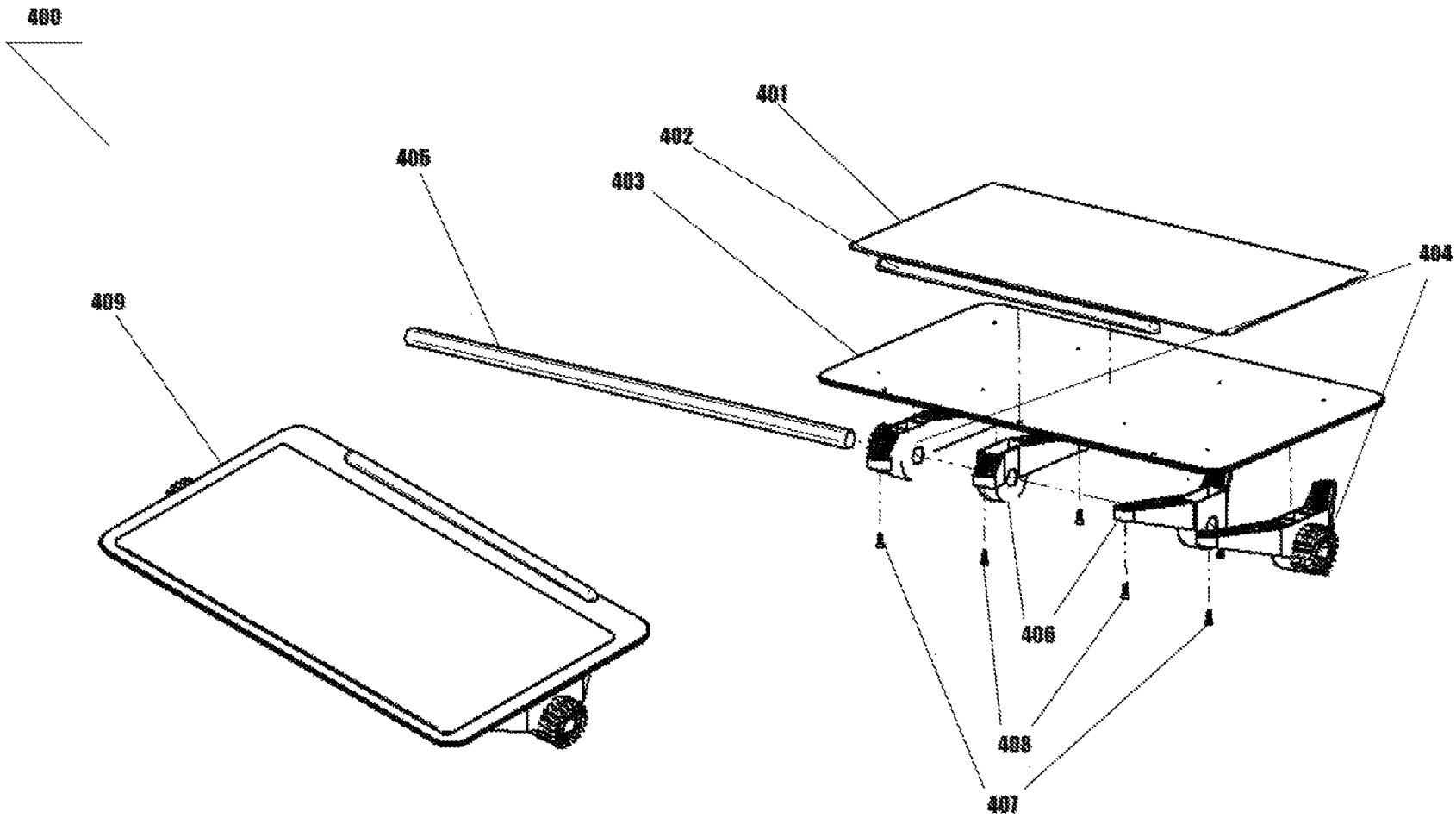
FIG. 8 shows the desktop assembly.

FIG. 8 depicts the desktop assembly 409. Exploded view shows the individual parts of the desktop assembly 409. Desktop plate 403 is connected to toothed wheels 404 by screws 407. Also toothed wheels 404 are supporting the weight of the desktop plate 403 and loads on top surface of the desktop plate 403. Middle supports 406 are connected to desktop plate 403 by screws 408. Middle supports 406 carry the weight in middle of the desktop plate 403. Stiffener bar 405 connects toothed wheels 404 and middle supports 406 while increases the strength of the desktop assembly 409. In diagram 500 Stopper bar 402 keeps object from sliding out of the tilted desktop assembly 409. In the same way pad 401 is helping object to stick on the surface of the desktop assembly 409 when tilted by increasing the friction between pad 401 and objects on top.

Figure 9:
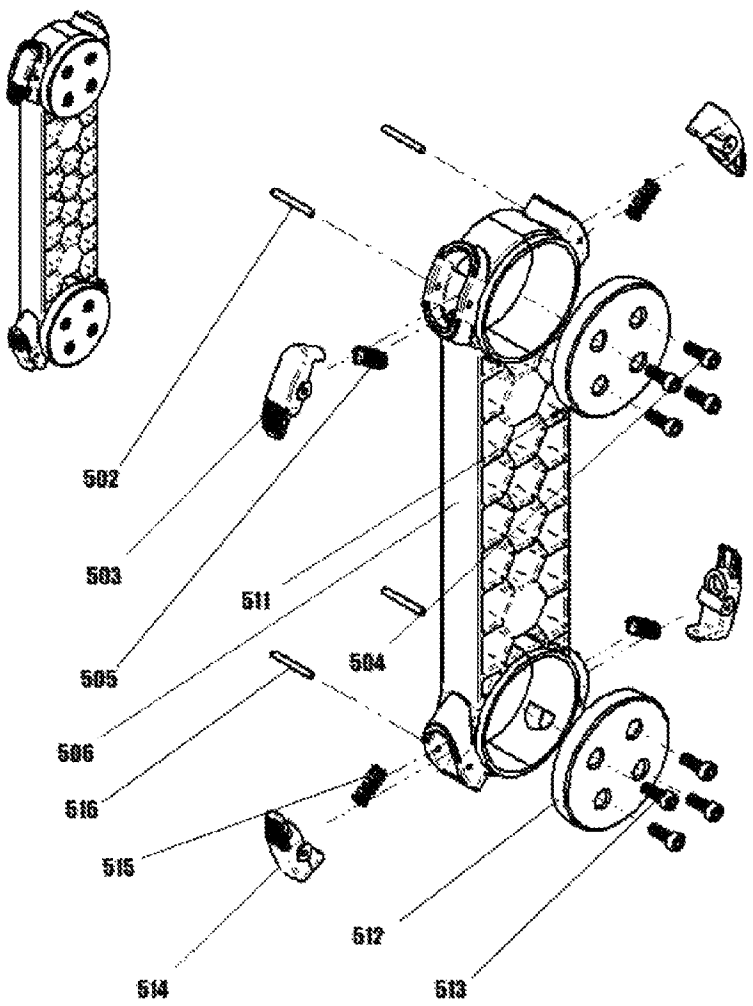
FIG. 9 shows the leg assembly.
Figure 9:
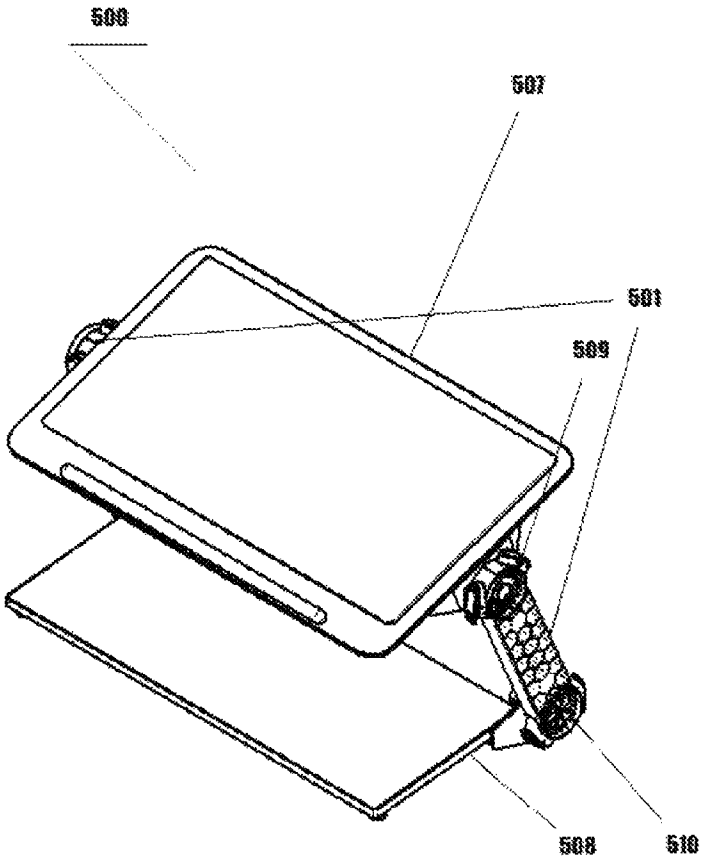

FIG. 9 shows two views of the identical leg assemblies 501 and also the main assembly of the invention. In diagram 500 invention is shown while cap 511 and 512 are removed to show the connection of the leg assembly 501 to base assembly 508 and desktop assembly 507. Leg assemblies 501 connects desktop assembly 507 to base assembly 508. Desktop assembly 507 pivots around inner cylindrical faces of the leg assemblies 501 via outer cylindrical faces of toothed wheels 509 on both sides of the device. Leg assemblies are connected to toothed wheels 509 by caps 511 and screws 504 on both sides of the device. Caps 511 are free to rotate with desktop assembly 507 and toothed wheels 509. Similarly leg assemblies 501 can rotate around outer cylindrical faces of the toothed wheels 510 on base assembly 508. Caps 512 and screws 513 connect the leg assemblies 501 to base assembly 508. Cap 512 and screws 513 are stationary when leg assembly 501 rotates around outer-cylindrical-faces of toothed wheels 510. Substantially two buttons 503 on opposite sides of leg 506 pivot around two pins 502 and pushed by springs 505 onto teeth of the toothed wheel 509. Therefore buttons 503 prevent desktop assembly 507 from rotating in clockwise and counter-clockwise directions. User's fingers press buttons 503 in order to disengage buttons on leg assemblies 501 from toothed wheels 509. Likewise two buttons 514 on opposite sides of each other pivot around two pins 516 and pushed by springs 515 onto teeth of the toothed wheel 510. Therefore buttons 514 prevent leg assemblies 501 from rotating in clockwise and counter-clockwise directions. User's fingers press buttons 514 in order to disengage leg assemblies 501 from toothed wheels 510 from base assembly 508.

Figure 10:
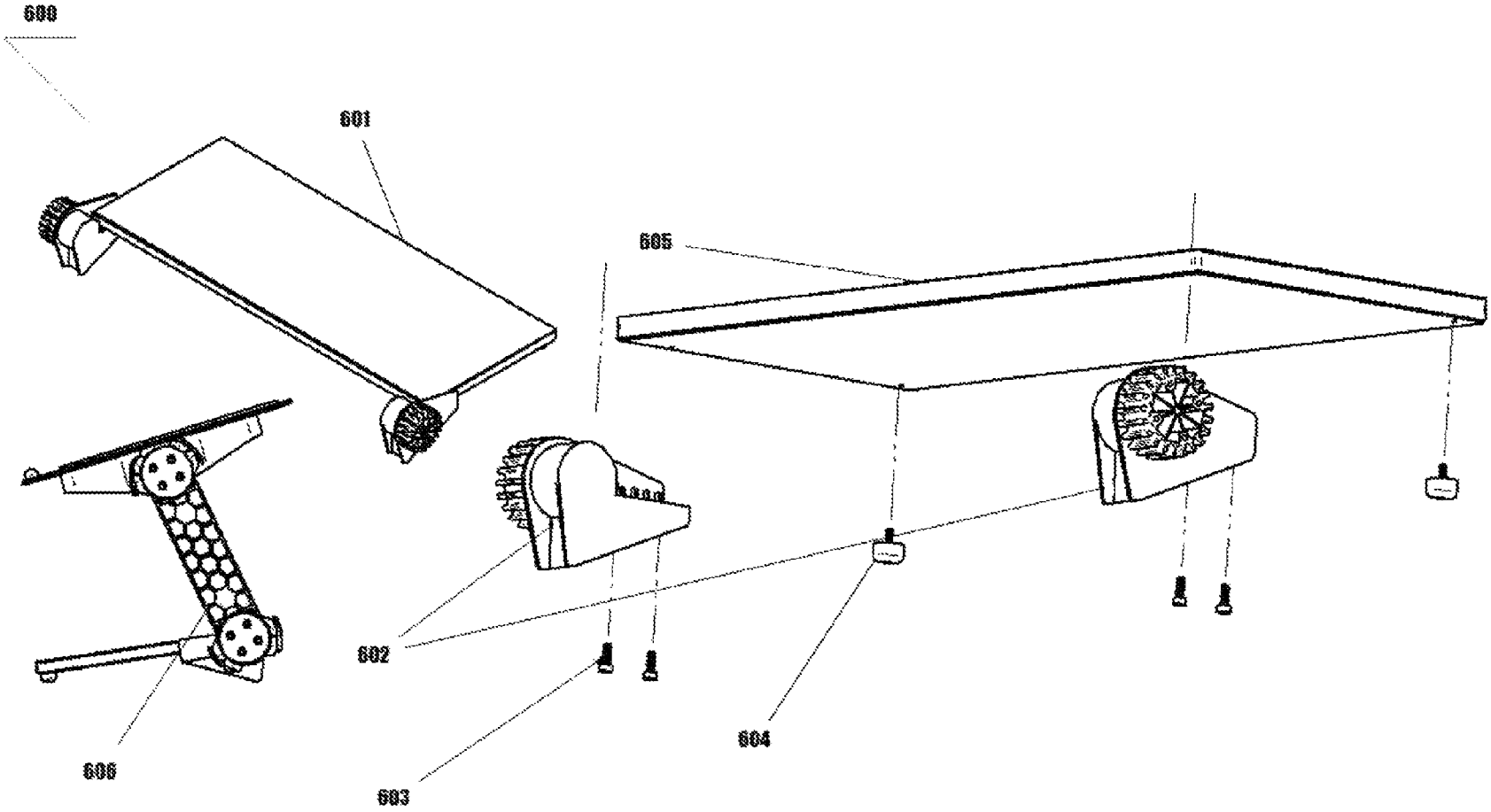
FIG. 10 shows the base assembly.

FIG. 10 depicts assembly of the base embodiment 601 in the invention. Toothed wheels 602 function as support of the invention on the floor. Furthermore, toothed wheels connect leg assembly 606 to the base assembly 601. Toothed wheels 602 on the left and right sides of the invention are connected by base plate 605. Also base plate 605 sits on the floor by two bumpers 604. Bumpers 604 are screwed onto base plate 605 and they are used for fine-height adjustment of the invention by screwing in and out in axial direction of the screws.

Figure 11:
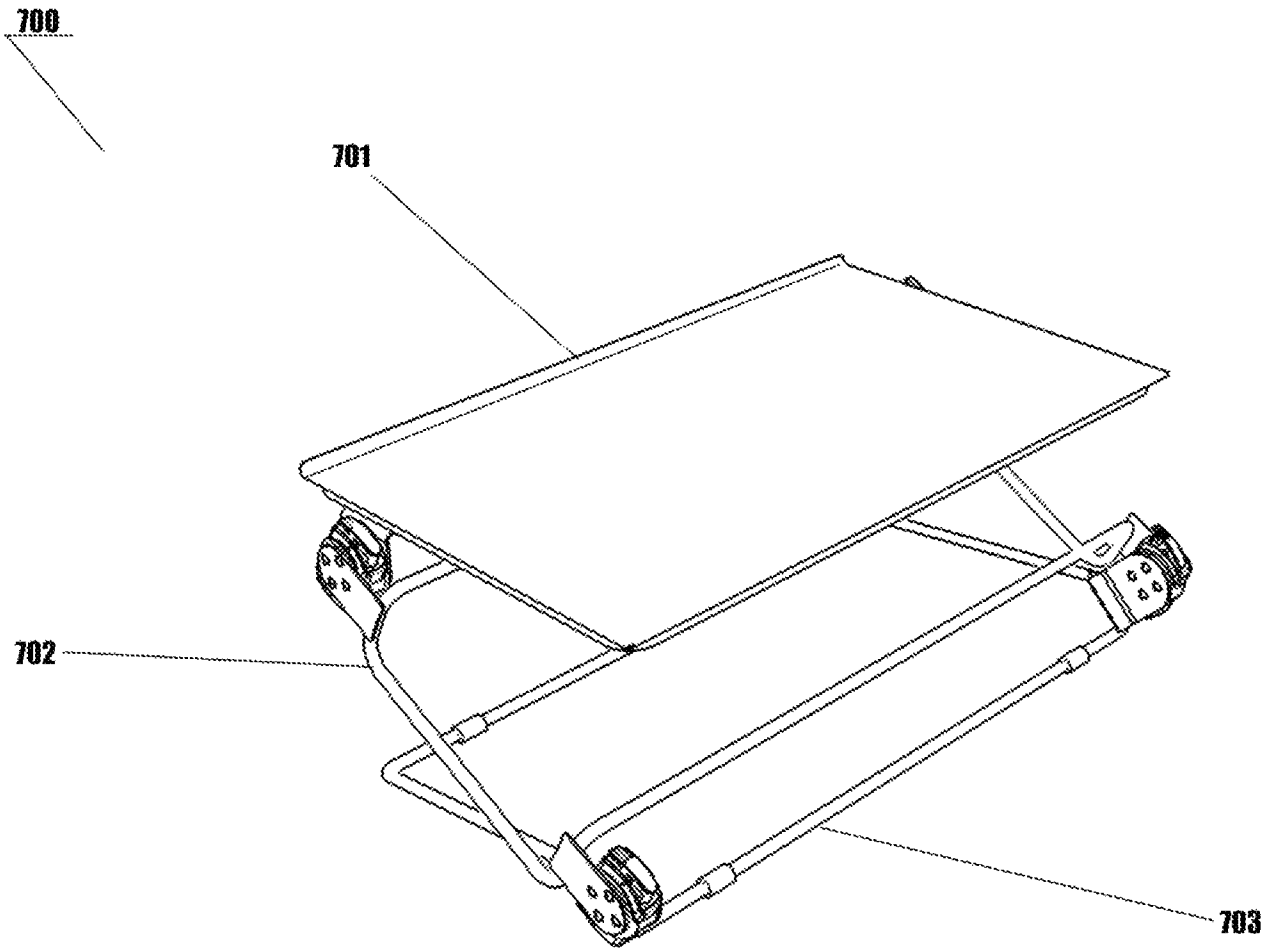
FIG. 11 shows the second embodiment of the entire invention.

FIG. 11 depicts second embodiment of the invention. Assembly 701 is held by locks located on leg assembly 702. Tilt on desktop assembly 701 can be adjusted by lock mechanism on leg assembly 702. Leg assembly 702 is engaged to base assembly 703 via locks whereby height of the desktop assembly 701 can be adjusted.

Figure 12:
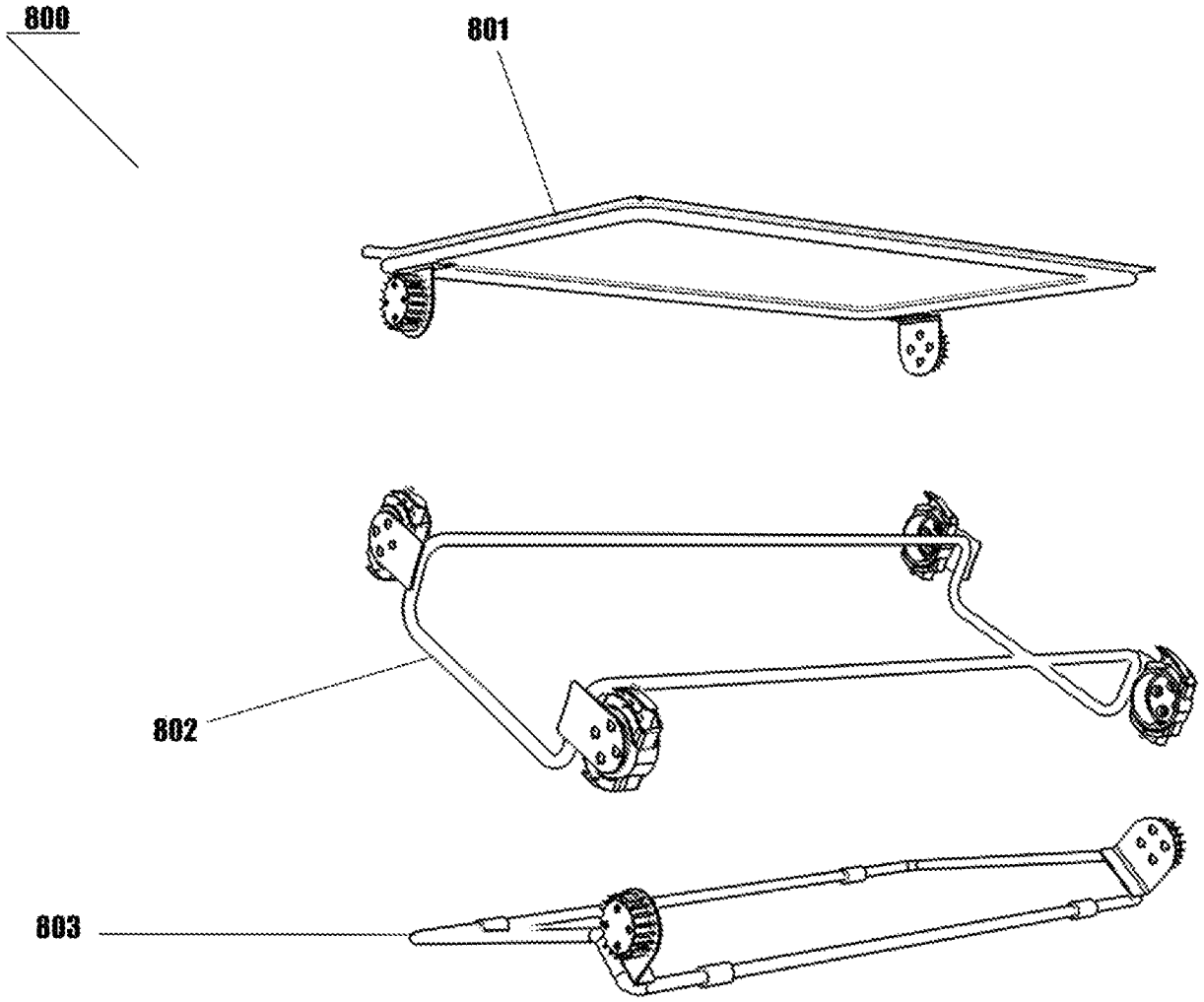
FIG. 12 shows the exploded diagram of desktop, leg and base assemblies.

FIG. 12 depicts the exploded diagram 800 of the invention which comprises desktop assembly 801, leg assembly 802 and base assembly 803. Desktop assembly 801 is able to swing relative to leg assembly 802 in order to adjust the tilt of the desktop assembly 801 relative to the user. Desktop assembly 801 and leg assembly are able to swing relative to base assembly 803 in order to adjust the height of the desktop assembly 801 relative to the user.

Figure 13:
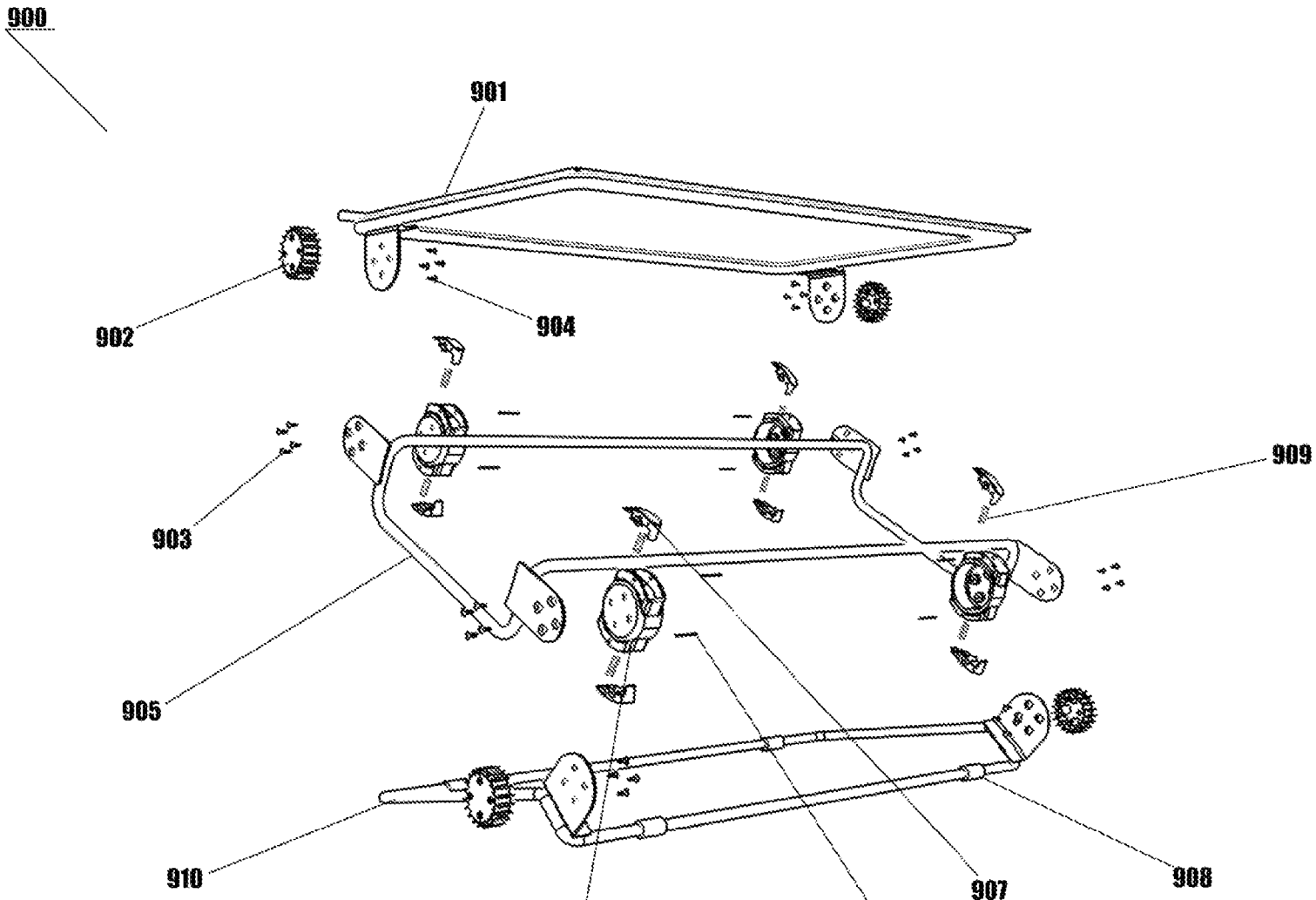
FIG. 13 shows the exploded diagram of all parts of the invention.

FIG. 13 depicts exploded diagram 900 of the second preferred embodiment of the invention where in all components are shown. Desktop assembly 901 and base assembly 910 are connected to four toothed wheels 902 via screws 904. Desktop assembly 901 and leg assembly 905 can pivot via external cylindrical faces of toothed wheel 902 onto internal cylindrical faces of four button holders 911. Button holders 911 are attached to the leg assembly 905 via screws 903. While base assembly 910 is resting on a flat surface, leg assembly 905 is free to pivot around toothed wheel 911 axis located on base assembly 910. Button holder 911 attached to leg assembly 905 holds springs 909 where by buttons 907 are loaded. Springs 909 swings the buttons 907 around pins 906 which are located on button holders 911. In the same manner desktop assembly 901 is free to pivot via external cylindrical faces of toothed wheel 902 onto internal cylindrical faces of button holders 911 located on left and right sides of the invention. Rotational movement of the desktop assembly 901 is limited by spring loaded buttons 907 at top portion of the leg assembly 905. By pressing four buttons 907 at top portion of the leg assembly 905 tongues on the buttons disengage from toothed wheel 902 and desktop assembly is free to pivot around axis of toothed wheels 902 located at top portion of leg assembly 905. When buttons 907 are released springs push them back by rotation around pins 906 and engage them with toothed wheels 902 at top portion of the leg assembly 905. Similarly, leg assembly 905 is engaged and disengaged at lower portion of the leg assembly 905 via inner cylindrical faces of the button holders 911 and buttons 907 to toothed wheels 902 located on left and right sides of the base assembly 910. By pressing four buttons 907 at lower portion of the leg assembly 910, leg assembly 910 can freely rotate about the axis of lower toothed wheels 902 and button holders 911. When four lower buttons 907 are released four springs 909 push the buttons 907 by pivoting them about pins 906 and engage buttons 907 tongues with lower toothed wheels 902 wherein leg assembly 905 is locked to rotate relative to base assembly 910.

Figure 14:
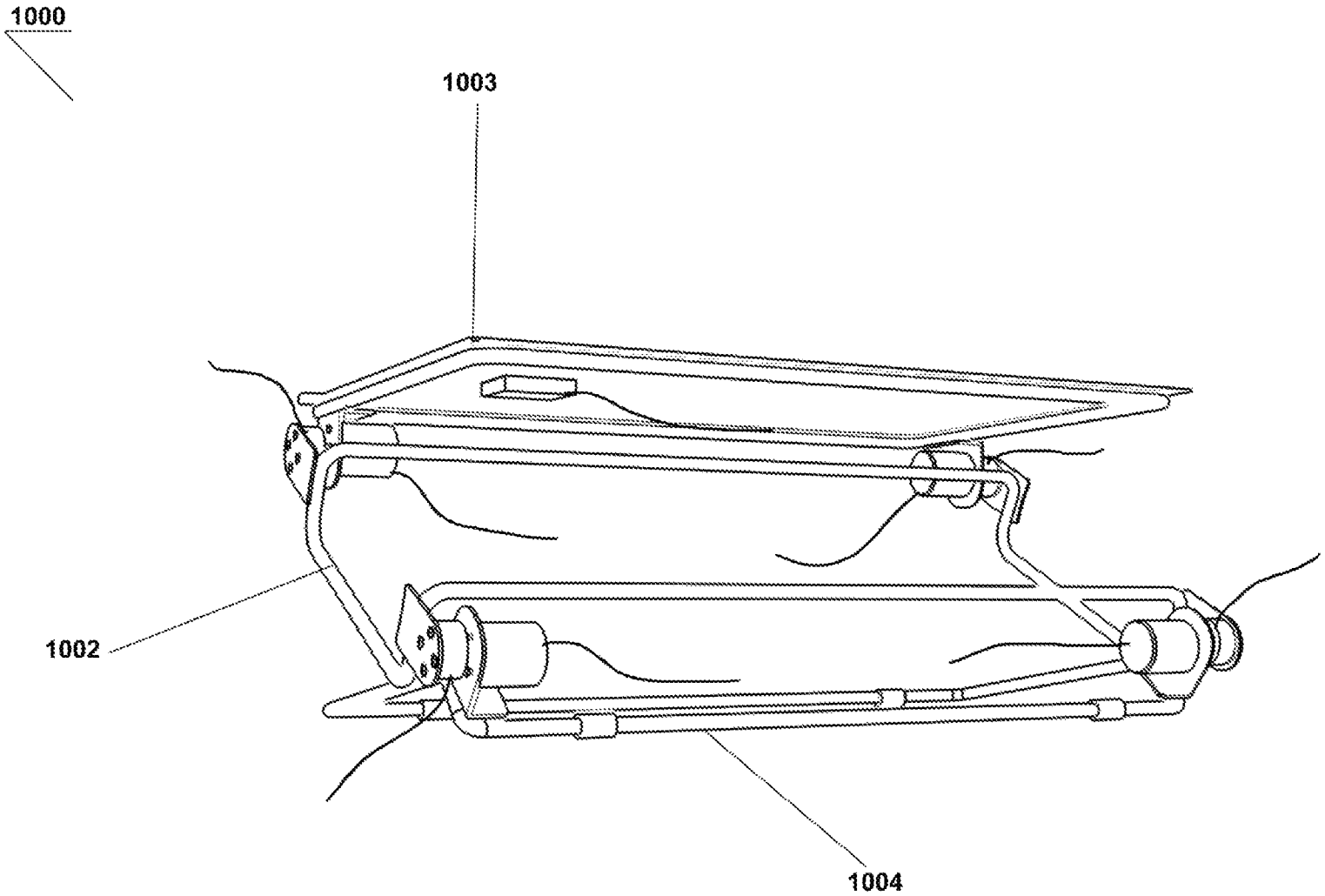
FIG. 14 shows the motorized embodiment of the invention.

FIG. 14 depicts the motorized embodiment of the invention. In diagram 1000, Desktop assembly 1003 pivots relative to leg assembly 1002. Leg assembly 1002 can pivot about relative to stationary base assembly 1004.

Figure 15:
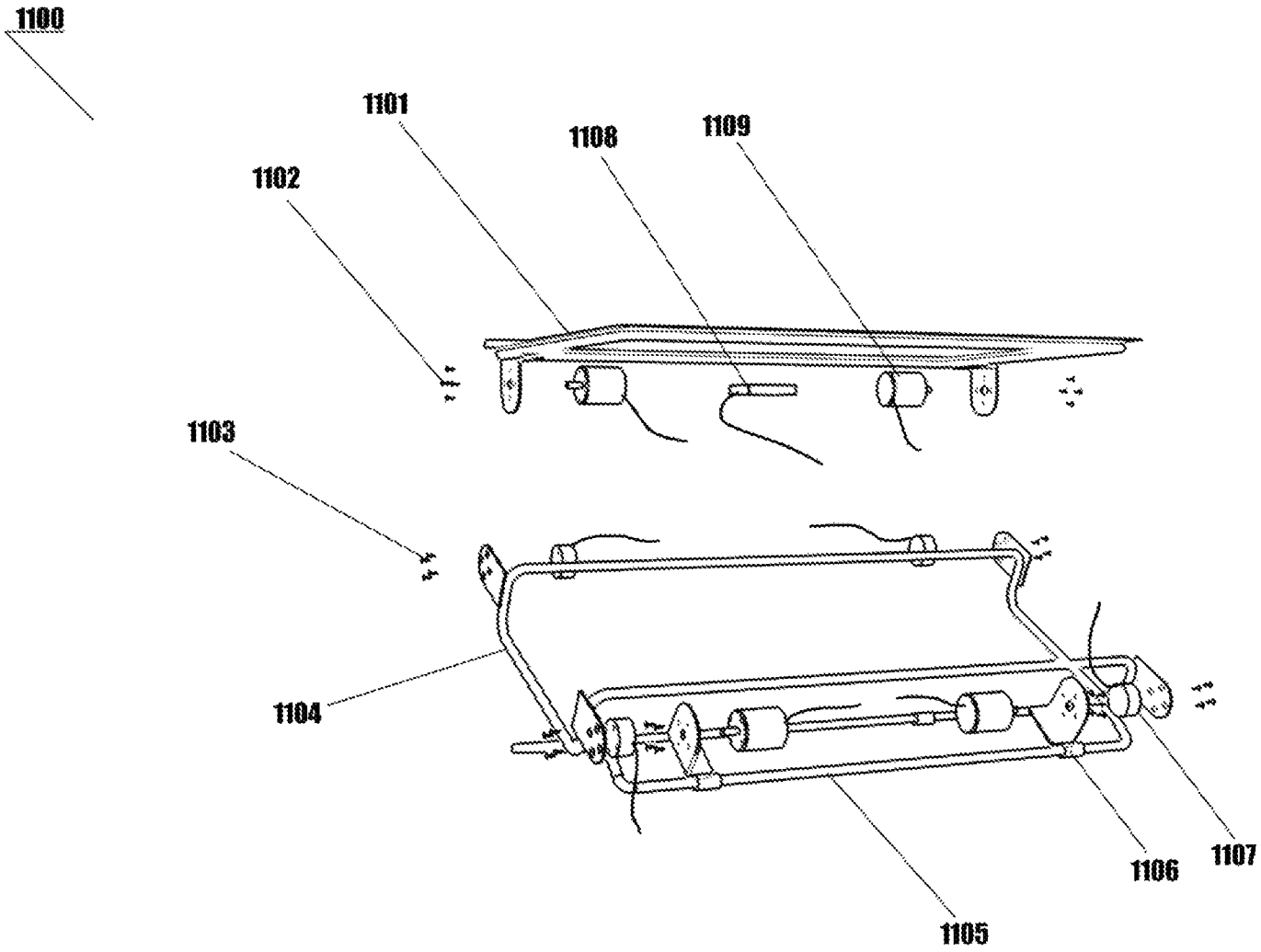
FIG. 15 shows exploded diagram of the motorized embodiment of the invention.

FIG. 15 depicts the exploded diagram 1100 of the motorized embodiment of the invention. Upper servo motor (s) 1109 pivot the desktop about location of the junction axis with leg assembly 1104 wherein tilt position of the desktop assembly 1101 can be adjusted by user commands via a computer application or push buttons. Wireless or wired commands are sent to the motors by control unit 1108. Also control unit has a gyroscopic sensor built in which measures the tilt and height amounts of desktop assembly 1101 relative to flat position where invention is mounted on. Measured angels are sent to computer application via control unit 1108. Likewise, leg assembly 1104 rotates about location of the junction axis with stationary base assembly 1105 by lower servo motor(s) 1109. Like upper servo motors

1109, lower servo motors 1109 receive position signals from control unit 1108 where in commands position are received by a wireless computer application or wired push buttons from the user. When there is no power, servo motors can free rotate due to the weight on top of the desktop assembly 1101 or self-weight of the invention parts. So, electrically powered brakes 1107 are mounted co-axially with servo motors out-put shafts. Brakes 1107 shafts are coupled at pivoting locations of the invention to servo motors 1109 shafts. Brake 1107 shafts are in brake mode mechanically when there is no electricity. So the invention is safely locked in position at all pivoting joints. When brakes 1107 receive a power signal from control unit 1108 they become released and servo motor 1109 shafts can rotate. In brakes 1107 release mode, servo motors 1109 can rotate in order to adjust tilt and height of the desktop assembly 1101. Soft bumpers 1106 are for increased grip of the invention to the flat surfaces. Also bumpers 1106 prevent scratches to the surface of the base assembly 1105 and also flat surface where invention is mounted on.

I claim:

1. An adjustable-foldable desk comprising:

a pair of legs, each leg comprising a linear support member, a first round face with associated locking feature, and a second round face with associated locking feature, the first and second round faces located at opposing ends of the linear support member;

a base comprising two toothed wheels that each engage with the first round face and associated locking feature of each leg of the pair of legs, respectively; and a desktop comprising two toothed wheels that each engage with the second round face and associated locking feature of each leg of the pair of legs, respectively;

wherein each locking feature comprises a pair of buttons, each button associated with a finger and a spring such that disengagement of each button prevents rotation of each toothed wheel relative to each engaged round face by engaging the respective finger and the respective toothed wheel, and a first button from the pair of buttons is associated with a clockwise direction of rotation and a second button from the pair of buttons is associated with a counterclockwise direction of rotation.

2. An adjustable-foldable desk comprising:

a base assembly;

a leg assembly coupled to the base assembly at a first junction axis, the first junction axis comprising at least a first motor and a first brake;

a desk assembly coupled to the leg assembly at a second junction axis, the second junction axis comprising at least a second motor and a second brake; and a control unit, wherein an angle between the leg assembly and the base assembly at the first junction axis is able to be manipulated by the control unit, and an angle between the leg assembly and the desk assembly is able to be manipulated by the control unit.

3. An adjustable-foldable desk comprising:

a leg assembly comprising a first set of structural members and multiple round faces with associated locking features;

a base comprising a second set of structural members and two toothed wheels that engage with two of the round faces and associated locking features of the leg assembly; and a desktop comprising a third set of structural members and two toothed wheels that engage with another two of the round faces and associated locking features of the leg assembly;

wherein each locking feature comprises a pair of buttons, each button associated with a finger and a spring such that disengagement of each button prevents rotation of each toothed wheel relative to each engaged round face by engaging the respective finger and the respective toothed wheel, and a first button from the pair of buttons is associated with a clockwise direction of rotation and a second button from the pair of buttons is associated with a counterclockwise direction of rotation, and wherein each structural member from the first set of structural members, second set of structural members, and third set of structural members comprises at least one tubular member, each tubular member having a length and diameter associated with a particular size and weight limit of the adjustable-foldable desk.

* * * * *